US005791567A

United States Patent [19]

Rebeaud

[11] Patent Number: 5,791,567

[45] Date of Patent: Aug. 11, 1998

[54] APPARATUS FOR PROCESSING USED METALLIZED BELTS OR BANDS

[75] Inventor: Jean-Claude Rebeaud, Le Mont-sur-Lausanne, Switzerland

[73] Assignee: Bobst SA, Lausanne, Switzerland

[21] Appl. No.: 638,176

[22] Filed: Apr. 26, 1996

[30] Foreign Application Priority Data

Apr. 28, 1995 [CH] Switzerland ..... 1225/95

[51] Int. Cl.[6] ..... B02C 18/22

[52] U.S. Cl. ..... 241/36; 241/62; 241/100; 241/101.4; 241/225; 241/236

[58] Field of Search ..... 241/36, 62, 101.4, 241/60, 236, 100, 225, 222, 224

[56] References Cited

U.S. PATENT DOCUMENTS

| | | | |
|---|---|---|---|
| 3,948,448 | 4/1976 | Wehren et al. | 241/62 X |
| 4,172,515 | 10/1979 | Wochnowski | 241/36 X |
| 4,200,239 | 4/1980 | Simone et al. . | |
| 4,615,490 | 10/1986 | Goldhammer | 241/36 |
| 4,678,126 | 7/1987 | Prentice et al. | 241/36 X |
| 5,114,490 | 5/1992 | Tilby | 241/225 |
| 5,167,374 | 12/1992 | Strohmeyer | 241/36 |
| 5,429,313 | 7/1995 | Schwelling | 241/36 |

FOREIGN PATENT DOCUMENTS

| | | | |
|---|---|---|---|
| 2 253 577 | 9/1992 | United Kingdom . | |
| 2 254 586 | 10/1992 | United Kingdom . | |
| WO88/04578 | 6/1988 | WIPO | 241/36 |

*Primary Examiner*—Mark Rosenbaum
*Attorney, Agent, or Firm*—Hill & Simpson

[57] ABSTRACT

An apparatus for processing used belts and bands of a machine for printing sheet elements comprises an accumulation bin having an upper portion for receiving the belts and bands from a supply arrangement and a lower portion provided with a grinder for grinding the belts and bands into small pieces. The grinder is automatically placed in operation intermittently under the control of a control arrangement, and the output of the grinder either discharges directly into a transport receptacle for the waste or into an evacuation pipe which conveys the waste to a transport receptacle at a remote location.

13 Claims, 1 Drawing Sheet

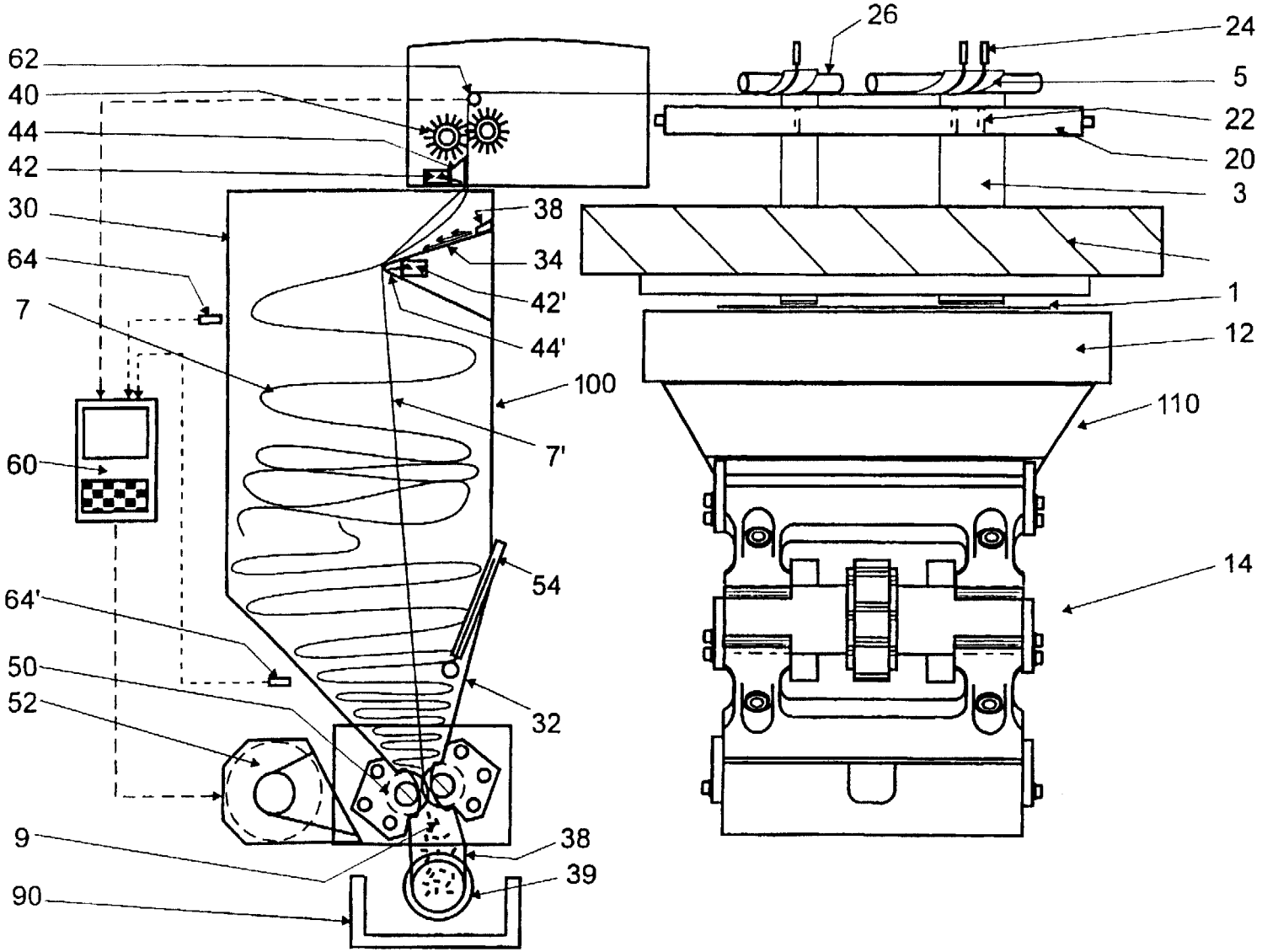
24
5
22
20
3
1
12
110
14
26
100
38
34
42'
44'
7'
54
32
38
39
62
40
44
42
30
64
7
60
64'
50
52
9
90

APPARATUS FOR PROCESSING USED METALLIZED BELTS OR BANDS

BACKGROUND OF THE INVENTION

The invention is directed to an arrangement or apparatus for processing used metallized belts or bands in a machine for transferring the metallized images from the band onto sheet elements, such as sheets of cardboard or plastic material. The invention is concerned with an arrangement or apparatus used in a platen press which comprises a fixed upper supporting beam or platen and a mobile lower supporting beam or platen, between which beams the cardboard sheet is led so that the metallized film coming from a belt conducted between this sheet and one of the platens can be printed onto the sheet according to a given pattern.

A platen press usually comprises, first, an input station in which is installed a stack of sheets, each sheet being successively removed from the top of the stack in order to be sent to a layout board. On the board, each sheet is placed in position against front and lateral stops before being grasped at a front edge by a series of clips, clamps or gripper fingers mounted along a transverse bar, whose ends are attached to lateral chain trains for leading the bar, and thus the sheet, into subsequent processing stations. The processing station may be a station for the transfer of a metallized film, possibly combined with cutting means, followed by a waste ejection station. The processing stations are finally followed by a receiving or delivery station in which each sheet is released from the clamps and falls squarely onto the top of a stack that accumulates on an output pallet.

An independent transport arrangement, made up of parallel metallized belts or bands, successively comprises a support for the belt supply bobbins, means for the intermittent unrolling and advancing of the belts, guiding means for guiding the belts or bands in a parallel fashion in a direction of movement of the sheet between the platens and then guiding the bands into a disengaged state around one of the platens of the press, a tension mechanism for placing the bands under tension at least along their path between the platens and an arrangement for the removal of worn or used bands from the machine, which usually is removable through a lateral window in the frame of the press.

The metallized bands or belts have an identical speed of intermittent unwinding pass through the same advancing and unrolling means, while the bands having a different speed pass through a second or even third separate unrolling and advancing means, the tension mechanism being controlled in this case as a function of a higher speed.

The tension mechanism usually consists of a tension roller driven either continually at a speed appreciably higher than the speed of advancement of the metallized band or a tension roller driven sequentially at a speed appreciably higher than the speed of advancement of the metallized band. In the two cases, the band is clamped between this roller and at least one pressure roller, whose pressure is controllable. Leaving this roller, the band makes a right-angle around a return bar in the direction of a lateral window of the frame of the machine, where it is ejected by two rotating brushes so as to fall into a tub or bag. Preferably, cutters situated close to the tension rollers cut the band longitudinally into several strips.

However, in practice, it turns out that these waste materials, being cut only longitudinally, fill the receiving tub or bag too rapidly, which bags must then be replaced very frequently by the operator. In addition, these bags form voluminous bundles that are cumbersome to transport.

SUMMARY OF THE INVENTION

An object of the present invention is to provide an arrangement or apparatus for processing waste consisting of used strips which may be bands or belts which may be cut longitudinally into the strips and possibly arriving at different speeds. The arrangement enables the reduction to the greatest possible extent of the volume of this waste so that it can be removed into more compact bags or even by pipes. The design of the arrangement must, however, remain simple for better long-term reliability of operation and so that the cost of the arrangement is reasonable.

To accomplish these goals, the arrangement or apparatus comprises means for transporting the used and/or worn strips, which include bands, belts or longitudinal cut bands or belts, an accumulation bin for receiving the strips at an upper part as they are supplied by said supply means, a grinder being disposed at a lower portion of the bin, control means for automatically setting the grinder into operation intermittently, said grinder having an output discharging into a waste transport receptacle. Preferably, the grinder is made up of two parallel cylinders situated facing one another and having interpenetrating cutters for the transverse and longitudinal cutting of the waste.

Thus, the used bands, belts and strips are cut into waste of small dimensions, in the manner of confetti, which thus fills the waste transport receptacle much more densely. The interval between two changes of the receptacle thus becomes longer, correspondingly freeing the operator.

According to the preferred embodiment, the bin comprises, in its upper part, a deflector oriented obliquely downward for diverting the initial fall of the used bands or strips toward the middle of the bin. If desired, a blower means may be provided to form a film of air on an upper surface of the deflector in order to eliminate friction and, thus, avoid the piling-up of the bands or strips at this point. Thus, the accumulation of the used bands or belts in the bin takes place in a very homogeneous manner, eliminating any risk of premature flow stoppage.

According to the preferred embodiment, a plurality of cutters, each sheathed by a block of a flexible material, such a rubber foam, is installed, either at the entrance into the bin from the supply means or else at a lower end of the deflector. The supply means, at the entrance bin, includes a pair of parallel brushes facing one another. If the band, which is normally the band having the lowest speed, is pulled by the grinder and placed under tension, it compresses the foam block and the band is impaled on one of the cutters, which cuts it instantly. Thus, no excess tension on the band can express itself in the upstream path of the band up to the supply bobbin, which would distort the registration of the band under the platen.

Preferably, the lower part of the accumulating bin is a downward conical portion bin oriented toward the input to the grinder with the result that the grinder is practically always in contact with the used band. If desired, it is possible to install, in an upper part of the conical portion of the bin, an inserting ram driven by an actuator, for example an electric, pneumatic or hydraulic jack, which is oriented in the direction of the input to the grinder in order to reinitialize the feeding of the band to the grinder if the grinder is idling.

Advantageously, the control means activates the grinder after the accumulation of a predetermined length of used band, as detected by a counting roller that may belong to the supply means of the band in the upper part of the bin. The grinder is placed into operation during a predetermined duration corresponding to the emptying of a greater part of the bin. This method is particularly simple and effective.

Alternatively, the control means comprises sensor means for detecting the filling of the bin to a predetermined maximum level, whose signal engages the grinder, as well as a sensor means for detecting the emptying of the bin to a predetermined minimum level, whose signal causes the grinder to stop. A sensor of this sort may, for example, comprise a plurality of photoelectric cells, whose reading of a light beam must be interrupted during a minimum time period for the majority of the cells in order to emit a control signal.

Advantageously, the grinder is driven by an electric motor provided with a means for measuring excess torque during an overload due to an excessive accumulation of the band or to the presence of a hard object. This means for measuring then causes a momentary driving of the grinder in the reverse direction to aid in clearing the grinder of a hard object or an enlarged mass of the band.

The grinder is usefully connected to the transport receptacle by a pneumatic tubing. Since the waste has been reduced to the size of confetti, it can easily be transported to another part of the shop by a simple stream of air produced by a ventilator or suction device, to a location where the transport receptacle is more easily accessible and removable. An indicator light or horn, indicating that the receptacle is full, is then provided.

Other advantages and features of the invention will be readily apparent from the following description of the preferred embodiments, the drawing and claims.

BRIEF DESCRIPTION OF THE DRAWING

The FIGURE is a schematic side view of the apparatus of the present invention with a front view of a platen press associated with a printing machine.

DESCRIPTION OF THE PREFERRED EMBODIMENTS

The principles of the present invention are particularly useful when incorporated in an apparatus generally indicated at 100 and having a bin or container, generally indicated at 30, which is utilized with a platen press that is indicated at 110. The press includes an upper horizontal platen 10 fixed to a frame of the press and a parallel subjacent platen 12 that is vertically mobile. For example, the lower platen 12 is supported by an arrangement 14 composed of a pair of parallel articulated joints facing one another, whose median axles are connected by one or several horizontal connecting rods to a rotating crankshaft installed between the articulated joints. Thus, the lower platen exerts an upward pressure on each of the sheets 1, carried sequentially in a horizontal motion by a bar with gripper fingers (not shown) against blocks fixed onto the board attached fixedly to the lower surface of the upper fixed platen.

More particularly, within the scope of the present invention, it is provided to insert between the sheet 1 and the printing blocks of the upper platen 10 an inking belt or band 3 or a metallized belt or band in order to deposit on the sheet 1 an image in a visible pigment, in particular having a metallic reflection. For this purpose, the means for intermittent unrolling and advancing (not shown) sequentially lead the band 3 under the platen 10, the band being taken on the other side by guiding rollers leading it upward in a direction of a tension roller 20 situated in the upper part of the machine, usually above the press 110 and near a front edge. The band or belt 3 is pressed against the tension roller 20 by a rear pressure roller 22. The speed of rotation of the tension roller 20 is greater than the unwinding speed of the bands as imposed by the means for intermittent unrolling, so as to induce a tension necessary and sufficient to hold the band correctly in the plane parallel to the platen 10 of the press 110.

At the output of the tension roller 20, the bands or belts are oriented at a right angle by a return idler 26 toward a lateral exit window in the frame of the press 110, where they are guided downwardly by a roller 62 before being driven into ejection by a pair of driving brushes 40. Cutters 24, which are installed either on the tension roller 20 or at the return idlers 26, make one or several longitudinal cuts, transforming the used metallic belts or bands into strips 7. The idlers 26 are mounted to rotate around an axis which is skewed to the axis of the roller 20.

According to the present invention, the strips 7 of the used bands or belts are not introduced directly into a transport receptacle 90, but first fall into an accumulation bin 30 of the apparatus 100.

As shown, the driving brushes 40 project the strips 7 through an inlet opening toward a deflector 34, which is oriented obliquely downwardly so that the strips 7 initially oriented in a vertical direction are oriented in a vertical median plane of the bin 30. In order to avoid any inopportune accumulation of the strips 7 at the entrance of the bin 30, a blower means 38 creates a stream of air along the oblique upper surface of the deflector 34. The strips 7, which are relatively light, thus, hardly touch the deflector 34, which cannot catch and hold them by friction. As shown, the strips then accumulate, according to a superposed folds of a width more or less equal to that of the bin.

More particularly, according to the invention, the lower part 32 of the bin 30 is obliquely oriented downwardly, as seen in a transverse direction and, thus, involves a converging conical portion or part 32. A lower end of this conical part 32 constitutes an approximately rectangular opening that opens into a grinder 50, in this case a chopper formed from two parallel cylinders arranged facing one another and bearing on their circumference a network of interpenetrating cutters. The geometry of this network of cutters is such that the grinder can shred the strips 7 longitudinally and transversely so as to reduce them to waste material 9 having a small dimension on the order of a few square centimeters. For this purpose, these rollers are driven in opposed rotational direction by an electric motor 52, with the left roller being driven in a clockwise direction and the right roller in the opposite direction so as to project the waste 9 downward into an output pipe 38.

This waste 9 can fall directly into a transport receptacle 90 placed immediately under the bin 30. Alternatively, the waste is drawn into an evacuation pipe 39 in which a flow of air current generated by a ventilator or fan will lead the waste to another location more appropriate for the installation and handling of the transport receptacle 90.

In order to be effective, the cutting cylinders of the grinder must turn at a minimum speed rapid enough that they cut the strips 7 significantly more rapidly than the rate the strips are accumulated in the bin 30. To this end, the grinder is placed into operation only intermittently, only as necessary, by control means 60. The control means 60 may be computerized and electronic means comprising a control unit executing a program previously stored in memory and modified by entering supplemental data by means of a keyboard in response to momentary results appearing on the screen.

According to a first method, the control means receives counting pulses emitted during the rotation of the counting roller 62, which may be one of the guide rollers preceding the drive brushes 40. Thus, when the passage of a quantity of strips sufficient to fill the greater part of the bin 30 has been counted, the control means 60 activates the electric motor 52 of the grinder 50 for a predetermined time period corresponding approximately to the time needed by the grinder in order to destroy this greater part of strips 7 in the bin 30. This time period may be adjusted by the operator by entering a new value at the keyboard.

Alternatively, two level detectors may be installed in the bin 30—a maximum level detector 64 and a minimum detector 64', each of which are connected to an entry card of the control means 60. These detectors may be, for example, a plurality of photoelectric cells receiving a light beam from a source of illumination situated against the facing side wall. When the maximum level has been effectively obtained, only a majority of the cells no longer receive the light beam during a predetermined interval, at least on the order of a second. The control means 60 then activates the grinder 50, and stops it as soon as the lower detector 64' is, in turn, tripped.

The conical shape of the lower part 32 of the bin 30 causes the grinder 50 to be normally in contact with one or several strips 7, permitting the next ones to be drawn along in the manner of spaghetti. If desired, a ram 54 in the form of an electric, pneumatic or hydraulic jack can be installed in the conical lower part 32 of the bin. The ram 54 has a rod that can extend downward in the direction of the grinder, with the end of the rod being provided with a pushing element, such as a ball or a rectangular plate. Thus, in the improbable case in which the grinder 50 is idling, the ram 54 can be activated in order to push the strips 7 into the path of the grinder to reinitiate the feed of the strips into the grinder.

The unwinding speed of the metallic bands or belts 3 in the platen press 110 depends directly on the size of the pattern to be successively printed. In other words, the bands or belts are advanced by the amount just necessary to cover the length of the pattern and, thus, optimize the consumption of the belt. If this length is short, the unwinding speed and, thus, the speed of accumulation of the corresponding strips in the bin is also short. During operations of the grinder 50, one of the strips could be completely shredded very rapidly and abruptly tightened, as illustrated by a strip 7' in the Figure.

To overcome any tension, an arrangement of hidden blades is provided at the start or entry of the strips into the bin or at the deflector 34. The arrangement comprises a plurality of cutters 42, 42' distributed at regular intervals along a crossbeam. Cutter blades 42 are sheathed in an elastic flexible material 44, while the blades 42' are in a block 44', which materials, when in an uncompressed state, extend beyond the blades. The material may be a foamed rubber or an elastic plastic material. In this manner, the strip led by the driving brushes 40 without tension will slide freely against the flexible blocks 44 and 44'. In contrast, as soon as the strip 7' is placed under tension, it will compress either the upper block 44 or the lower block 44', which, by retracting, exposes the point or edge of one of the cutters, such as 42 or 42', which instantly tears and cuts the strip. Thus, no excess tension can be expressly applied against the upstream area, in particular at the tension roller 20.

Although various minor modifications may be suggested by those versed in the art, it should be understood that I wish to embody within the scope of the patent granted hereon all such modifications as reasonably and properly come within the scope of my contribution to the art.

I claim:

1. An apparatus for processing used strips in a machine for printing sheet elements, said apparatus comprising an accumulation bin having an upper part with an inlet opening and a lower part with an outlet opening, supply means for transporting used strips to said inlet opening, said supply means including driving brushes, a grinder being disposed at the outlet opening of the bin having a discharge opening for discharging ground waste into a discharge transport receptacle, and control means for operating the grinder intermittently.

2. An apparatus according to claim 1, wherein upper part has a deflector oriented obliquely downward for diverting an initial fall of used strips toward the middle of the bin.

3. An apparatus according to claim 2, wherein blower means are provided for forming a film of air moving along an upper surface of the deflector.

4. An apparatus according to claim 2, which includes cutter means being installed in at least one of the inlet opening to the bin and a lower edge of the deflector for cutting strips placed under tension, said cutter means including a plurality of cutters being sheathed in a block of flexible material compressible from a position covering said cutters to a position exposing said cutters.

5. An apparatus according to claim 1, wherein the bin has a lower part of a converging conical portion oriented toward the outlet opening connected to said grinder.

6. An apparatus according to claim 5, which includes an insertion ram driven by an actuator being positioned in the conical portion and oriented in the direction of the outlet opening for pushing strips into the grinder.

7. An apparatus according to claim 1, wherein the control means includes a counter-roller positioned in the supply means for the strip, said control means receiving a signal from the counter-roller after a given length of strips have passed, said control means activating the grinder to operate for a set period of time to empty the strip from the greater part of the bin in response to a signal from said counter-roller.

8. An apparatus according to claim 7, wherein the grinder includes an electrical motor for driving the grinder, said electrical motor having means for measuring excess loads during an overload, said means for measuring causing a momentary driving of the grinder in a reverse direction to clear the grinder.

9. An apparatus according to claim 1, wherein the grinder is connected to a pneumatic tube of a waste transfer arrangement for transporting the waste from the discharge opening of the grinder to a transport receptacle.

10. An apparatus according to claim 1, which includes first detector means and second detector means, said first detector means being positioned to determine an upper level of the strip in said bin, the second detector means being positioned to determine a lower level, said first detector means emitting a signal, when the level of strips in the bin reaches the level of the first detector, to the control means which actuate the grinder to begin grinding the strips in the bin, said second detector means emitting a signal, when the level of strips in the bin drops to the level of the second detector, to cause the control means to stop the grinder.

11. An apparatus for processing used strips in a machine for printing sheet elements, said apparatus comprising an accumulation bin having an upper part with an inlet opening and a lower part with an outlet opening, said upper part having a deflector oriented oblique downward for diverting an initial fall of used strips toward a middle of the bin, supply means for transporting used strips to said inlet opening, a grinder being disposed at the outlet opening of the bin having a discharge opening for discharging ground waste into a discharge transport receptacle, control means for operating the grinder intermittently, and said bin having cutter means for cutting any strips being placed under tension by the grinder, said cutter means including a plurality of cutters being sheathed in a block of flexible material compressible from a position covering said cutters to a position exposing said cutters.

12. An apparatus according to claim 11, which include blower means for forming a film of air moving along an upper surface of the deflector.

13. An apparatus according to claim 11, wherein the control means includes a counter-roller positioned in the supply means for the strip, said control means receiving a signal from the counter-roller after a given length of strips have passed, said control means activating the grinder to operate for a set period of time to empty the strip from a greater part of the bin in response to a signal from said counter-roller.

* * * * *